United States Patent [19]

Hill

[11] Patent Number: 4,640,564

[45] Date of Patent: Feb. 3, 1987

[54] ELECTRICAL OUTLET FACEPLATE WITH LOCKING CLOSURES

[76] Inventor: Joe W. Hill, 23320 SE. 271st, Maple Valley, Wash. 98038

[21] Appl. No.: 835,999

[22] Filed: Mar. 4, 1986

[51] Int. Cl.[4] ..... H01R 13/44

[52] U.S. Cl. ..... 339/40; 339/36

[58] Field of Search ..... 174/67; 339/36, 40

[56] References Cited

U.S. PATENT DOCUMENTS

| | | | |
|---|---|---|---|
| 2,477,803 | 8/1949 | Huber | 173/330 |
| 2,559,151 | 7/1951 | Getzoff | 173/330 |
| 2,710,382 | 6/1955 | Fitzpatrick et al. | 339/40 |
| 2,744,243 | 5/1956 | Menendez | 339/36 |
| 2,818,991 | 1/1958 | Hess | 174/67 |
| 2,934,591 | 4/1960 | Tiikkainen | 174/67 |
| 3,068,442 | 12/1962 | Kubik et al. | 339/36 |
| 3,201,740 | 8/1965 | Rubens | 339/40 |
| 3,865,456 | 2/1975 | Dola | 339/36 |
| 3,980,371 | 9/1976 | Kahn et al. | 339/40 |
| 4,094,569 | 6/1978 | Dietz | 339/39 |
| 4,159,858 | 7/1979 | Toraya | 339/12 |
| 4,168,104 | 9/1979 | Buschow | 339/40 |
| 4,206,957 | 6/1980 | Ludwig et al. | 339/36 |
| 4,302,624 | 11/1981 | Newman | 174/67 |
| 4,379,607 | 4/1983 | Bowden, Jr. | 339/40 |
| 4,549,778 | 10/1985 | Price et al. | 339/40 |

*Primary Examiner*—Gil Weidenfeld
*Assistant Examiner*—P. Austin
*Attorney, Agent, or Firm*—Joan H. Pauly

[57] ABSTRACT

A faceplate body (16,30) has apertures (20,34) which are aligned with the receptacles (6) of an electrical outlet (4). A pair of shutters (46) are received between the front plate (16) and inner liner (30) of the body (16,30) and reciprocate between closed positions in which they block the apertures (20,34) and open positions in which they are adjacent to the apertures (20,34). Springs (58) bias shutters (46) into their closed positions. A lock (62) has a sliding member (64) that is biased by a spring (70) into interlocking engagement with the shutters (46). A release button (68) is secured to the sliding member (64) and may be pushed laterally to move the sliding member (64) away from the shutters (46) to allow one or both shutters (46) to be moved into their open positions. Each shutter (46) has a projection (52) with a finger tab (54) for moving the shutter (46) against the force of the springs (58). The projection (52) has a stepped configuration to allow the shutter (46) to be held open by a finger without obstructing the aperture (20,34).

11 Claims, 6 Drawing Figures

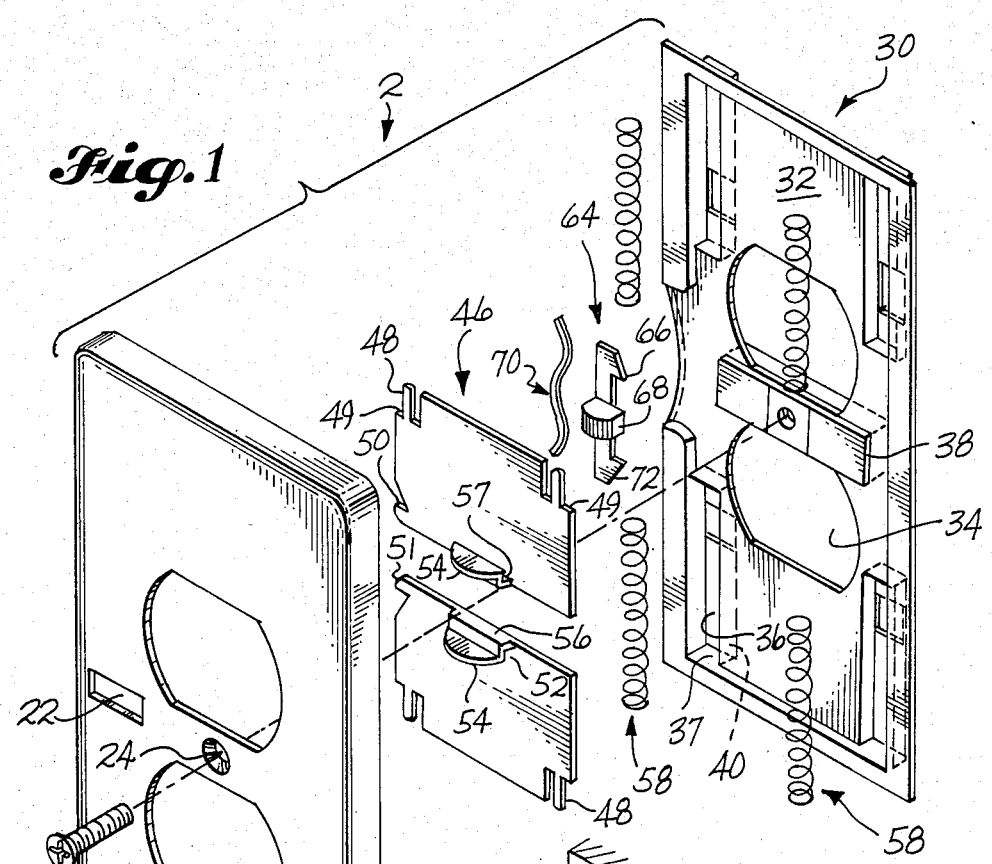
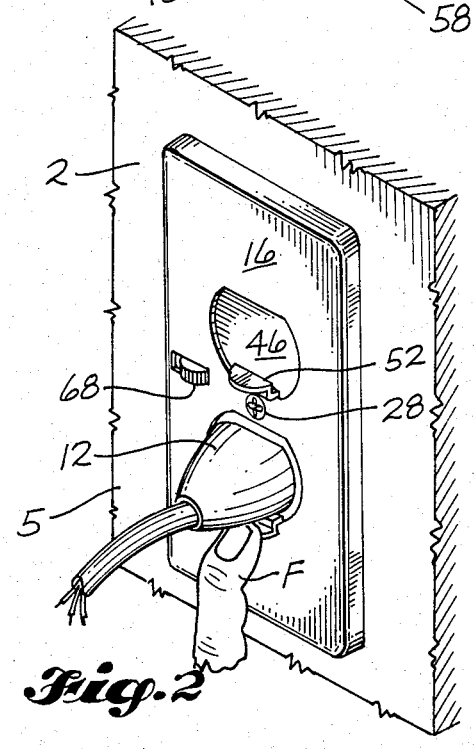
Fig. 2

ELECTRICAL OUTLET FACEPLATE WITH LOCKING CLOSURES

TECHNICAL FIELD

This invention relates to faceplates for electrical outlets and, more particularly, to such a faceplate with sliding shutters that cover the prong receiving openings of the outlet and means for positively locking the shutters in a closed position.

BACKGROUND ART

In residential and other structures, electrical outlets are generally positioned a short distance above the floor. This makes the outlets readily accessible to small children. A curious child is inclined to test and probe his environment and may stick objects, such as paper clips, into the prong receiving openings of an electrical outlet. This exposes him to the danger of shock or even death.

In spite of generally widespread knowledge of the dangers that electrical outlets present to small children, very few devices are commercially available for denying a child access to an outlet. The most commonly available device is a small plastic disk with prongs that plug into the openings of an outlet receptacle. The disk covers the receptacle and takes the place of an electrical plug to prevent insertion of any other object in the openings. A major disadvantage of this type of device is that the disk may easily become lost or mislaid when it is temporarily removed to allow normal use of the outlet.

There have been a number of proposals for providing a permanently mounted safety cover for electrical outlets to make the prong receiving openings inaccessible to a child. Such proposals generally provide an inadequate solution either because the safety cover is too easily defeated by a child who is still too young to understand the dangers of electricity or because the covering device is unduly complicated and/or cumbersome.

U.S. Pat. No. 3,068,442, granted Dec. 11, 1962, to J. T. Kubik et al., discloses a box-like cover that fits over a conventional outlet faceplate or has a back wall which forms a faceplate. Two sliding bars are mounted in the cover and are biased by coil springs into a position in which they cover the sockets of the outlet. A slide member is mounted in the cover and has a tab that projects upwardly from the top of the box. The tab may be pressed downwardly to cause the slide member to engage the bars and push them downwardly against the force of the springs to uncover the sockets.

U.S. Pat. Nos. 2,477,803, granted Aug. 2, 1949, to C. A. Huber, and 3,865,456, granted Feb. 11, 1975, to F. P. Dola, each disclose a cover plate for an electrical outlet which has slidable shutters for covering the prong receiving openings of the outlet sockets. The shutters have apertures extending therethrough for receiving the prongs of an electrical plug. The shutters are spring biased into a position in which the apertures are offset from the openings in the sockets, and may be moved into a position in which the apertures and openings are aligned by inserting the prongs of an electrical plug into the apertures and moving it against the force of the spring. The shutters in the Dola cover plate have beveled edges that slide in V-shaped guideways formed in the main body of the cover plate.

U.S. Pat. No. 2,710,382, granted June 7, 1955, to J. P. Fitzpatrick et al., also discloses a cover for an electrical outlet that has slidable apertured shutters. In one embodiment, the shutters are spring biased into an offset position, and in another embodiment gravity acts on the shutters to move them into an offset position. The cover includes a front or outer plate and a rear or inner plate. The inner plate has ridges that define the spaces in which the shutters reciprocate and provide guides for the movement of the shutters. In the spring biased embodiment, the springs are mounted in the spaces defined by the ridges. The rear surface of the inner plate has a pair of recesses for receiving the sockets of the outlet and a rearwardly projecting lateral lug that fits between the sockets.

U.S. Pat. No. 2,744,243, granted May 1, 1956, to G. H. Menendez, discloses a safety cover for an electrical outlet having apertured, gravity-actuated slides or shutters. The device includes a rear insulative plate and a front cover plate that defines recesses between itself and the insulative plate. The shutters reciprocate in the recesses. In one embodiment, each slide is tiltable in its recess and has lateral projections which engage depressions in the sides of the recess to prevent the shutter from being moved into its aligned position when it is tilted as opposed to being raised vertically. This arrangement is intended to prevent a child from aligning the shutter by inserting an object into one of the apertures and pushing on the shutter.

U.S. Pat. Nos. 4,168,104, granted Sept. 18, 1979, to D. W. Buschow, and 4,379,607, granted Apr. 12, 1983, to W. R. Bowden, Jr., each disclose an arrangement in which the openings of an electrical outlet are covered by shutters and which includes a mechanical mechanism for moving the shutters out of a blocking position. The Buschow device is operated by inserting the ground pin of an electrical plug into the device, and the Bowden, Jr. device is operated by inserting the two prongs of a plug simultaneously.

U.S. Pat. Nos. 2,559,151, granted July 3, 1951, to E. M. Getzoff, and 4,302,624, granted Nov. 24, 1981, to F. M. Newman, each disclose an electrical outlet protector having covers for the outlet sockets that pivot between open and closed positions. In the Newman device, spring biased shutters are pivotably attached to a main body. One embodiment includes a detent on the shutter that engages a recess in the body to provide resistance to opening of the device. In another embodiment, the shutter has a tab thereon which enters a recess in a center bar of the body when the shutter is closed. This prevents the shutter from being pried or lifted away from the socket, but allows the shutter to be pivoted into its open position.

U.S. Pat. Nos. 3,980,371, granted Sept. 14, 1976, to B. I. Kahn, 4,094,569, granted June 13, 1978, to E. W. Dietz, and 4,206,957, granted June 10, 1980, to M. S. Ludwig et al., each disclose a cube tap for an electrical extension cord having a spring biased apertured cover for the prong receiving openings. Safety covers for electrical outlets are disclosed by U.S. Pat. Nos. 2,934,591, granted Apr. 26, 1960, to V. V. Tiikkainen, and 3,201,740, granted Aug. 17, 1965, to G. J. Rubens. U.S. Pat. No. 4,159,858, granted July 3, 1979, to J. E. Toraya, discloses a cover plate for an electrical outlet having hinge mounted doors that cover the sockets and a magnetic lock to prevent the doors from being opened.

The above patents and the prior art that is discussed and/or cited therein should be studied for the purpose of putting the present invention into proper perspective relative to the prior art.

DISCLOSURE OF THE INVENTION

A subject of the invention is a faceplate for an electrical outlet of the type having at least one set of openings for receiving prongs of an electrical plug. According to an aspect of the invention, the faceplate comprises a body dimensioned to cover the outlet and having an aperture therein alignable with the openings to allow insertion of the prongs of an electrical plug into the openings. A shutter has a closed position in which it blocks the aperture and an open position in which it is adjacent to the aperture. The shutter includes an edge portion with an interlocking surface. Spring means biases the shutter into its closed position. Tab means is carried by the shutter for manually sliding the shutter from its closed position into its open position against the force of the spring means. Releasable lock means is provided for preventing the shutter from sliding out of its closed position toward its open position. The lock means includes an interlocking portion, resilient means, and a release member. The resilient means urges the interlocking portion toward the shutter and into interlocking engagement with the interlocking surface of the shutter to positively lock the shutter against sliding out of its closed position toward its open position. The release member is carried by the interlocking portion for manually sliding the interlocking portion against the force of the resilient means away from the shutter and out of engagement with the interlocking surface to allow the tab means to be operated to slide the shutter into its open position.

Faceplates constructed according to the invention provide an effective solution to the problem of preventing small children from being injured by playing with electric outlets. Faceplates of the invention are relatively simple in structure and inexpensive to manufacture and may easily be installed in an existing structure. An important feature of the faceplate of the invention is the positive locking of the shutter that covers the prong receiving openings. In order to gain access to the openings, a person must perform two separate operations simultaneously. The interlocking portion of the lock means must be moved away from the shutter and held in a disengaged position while the tab means is simultaneously operated to move the shutter toward its open position. The need to perform this dual operation effectively prevents a small child from gaining access to the prong receiving openings without interfering with convenient access to the outlet for use by adults. Following use of the outlet, the spring means and resilient means automatically reset the shutters into a closed locked position. There is no need for any affirmative resetting action which might be forgotten, and there are no loose parts which could be mislaid.

Another important feature of the invention is tab means comprising a projection that projects substantially perpendicularly outwardly from an edge of the shutter, extends generally parallel to the shutter, and terminates in a finger tab. The projection is positioned and dimensioned to allow a person to hold the shutter in its open position by pressing a finger against the finger tab without blocking any portion of the aperture with such finger. This feature allows the size of the aperture and corresponding shutter to be kept to a minimum while maintaining unobstructed access to the outlet when the shutter is in its open position. In the preferred embodiment, the projection includes two opposite stop surfaces that abut the body of the faceplate when the shutter is in its open and closed positions, respectively. This multiple functioning of the projection increases the overall efficiency of the structure of the faceplate.

In the preferred embodiment of the faceplate, the body includes outer wall means and inner wall means between which the shutter and the interlocking portion of the lock means slide and which form guide surfaces for guiding movement of the shutter and the interlocking portion. Preferably, the spring means includes two coil springs that engage opposite corner portions of the shutter, and the inner and outer wall means define therebetween recesses for receiving and positioning the coil springs. Also preferably, the inner wall means is formed from molded plastic, and the resilient means is formed integrally with the inner wall means.

The faceplate of the invention may be adapted to cover an electrical outlet having receptacles for one, two, or more electrical plugs. In one form, the faceplate is adapted to cover an electrical outlet of the type having two sets of openings for receiving prongs of two electrical plugs. This form of the faceplate comprises a body dimensioned to cover the outlet and having a pair of apertures therein. Each aperture is aligned with a different one of the sets of openings to allow insertion of prongs into the openings. The faceplate has a shutter corresponding to each aperture, and each shutter has a closed position in which it blocks the corresponding aperture and an open position in which it is adjacent to the corresponding aperture. Each shutter includes an edge portion with an interlocking surface. Spring means biases the shutters into their closed positions. Tab means is carried by each shutter for manually sliding the shutter from its closed position into its open position against the force of the spring means. Releasable lock means prevents the shutters from sliding out of their closed positions toward their open positions. The lock means includes an interlocking portion, resilient means, and a release member. The resilient means urges the interlocking portion toward the shutters and into interlocking engagement with the interlocking surfaces of the shutters to positively lock the shutters against sliding out of their closed positions toward their open positions. The release member is carried by the interlocking portion for manually sliding such portion against the force of the resilient means away from the shutters and out of engagement with the interlocking surfaces to allow the tab means to be operated to slide the shutters into their open positions.

The dual shutter form of the faceplate is generally preferred since it is adapted to cover the vast majority of electrical outlets currently in use. It has the advantages discussed above of requiring the coordinated operation of two separate mechanisms in order to gain access to the electrical receptacles of the outlet, to deny access to small children while providing convenient access for adults.

These and other advantages and features will become apparent from the detailed description of the best mode for carrying out the invention that follows.

BRIEF DESCRIPTION OF THE DRAWINGS

In the drawings, like element designations refer to like parts throughout, and:

FIG. 1 is an exploded pictorial view of the preferred embodiment of the faceplate.

FIG. 2 is a pictorial view of the faceplate of FIG. 1 installed on a wall outlet and receiving an electrical plug.

BEST MODE FOR CARRYING OUT THE INVENTION

Figure 4:
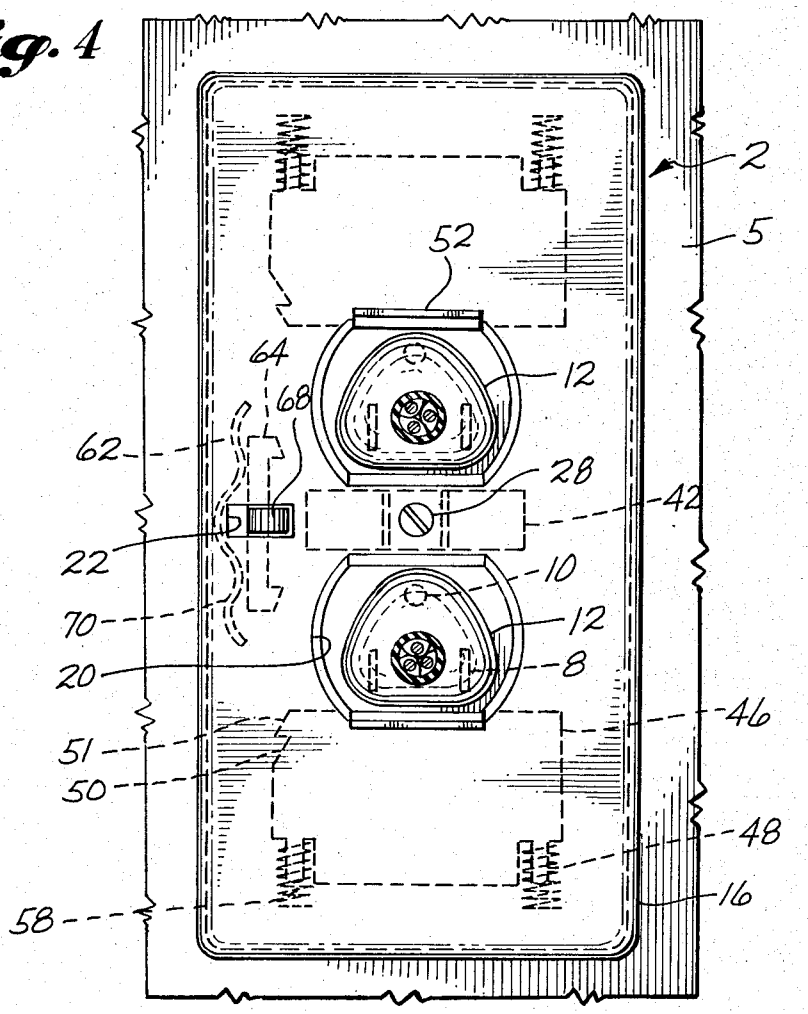
FIG. 4 is a front elevational view of the faceplate shown in FIGS. 1-3 installed on an outlet and receiving two electrical plugs, with the cords associated with the plugs shown in section.
Figure 3:
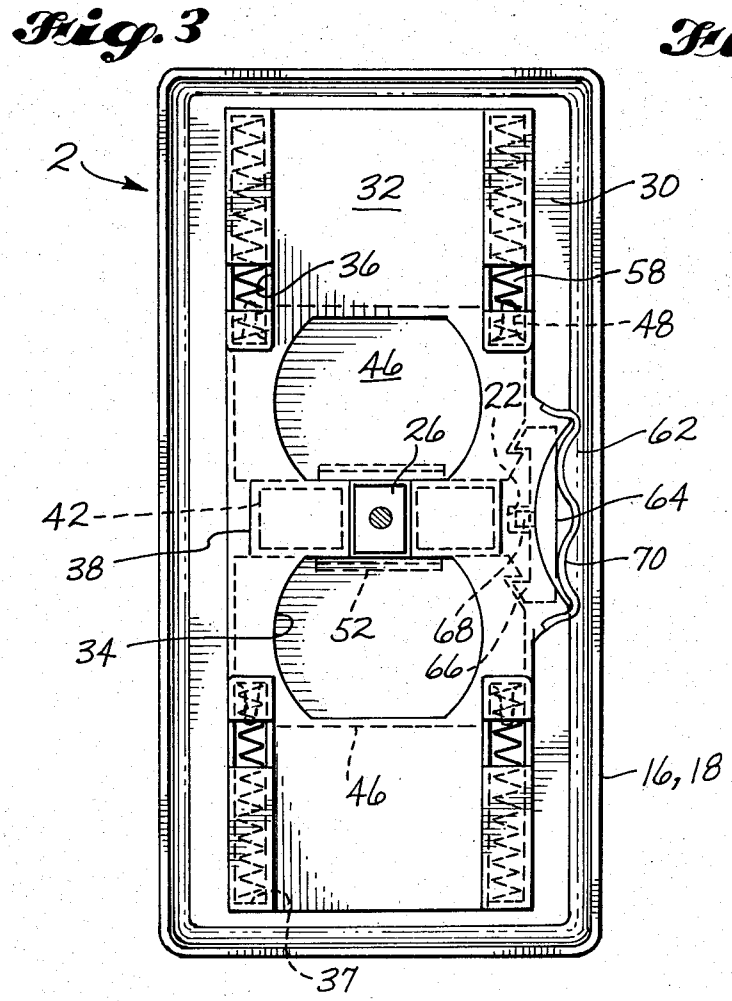
FIG. 3 is a rear elevational view of the faceplate shown in FIGS. 1 and 2, viewed from the line 3—3 in FIG. 6.
Figure 6:
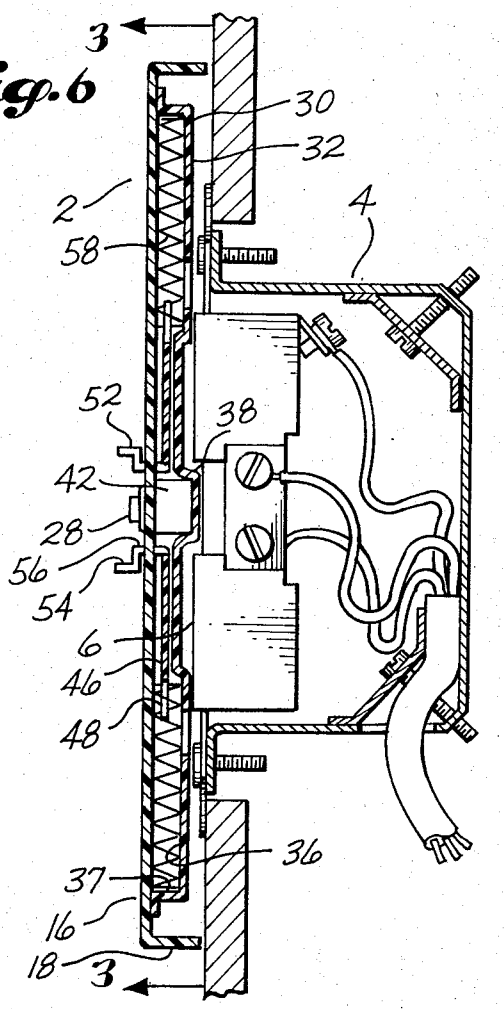
FIG. 6 is a sectional view taken along the line 6—6 in FIG. 5.
Figure 5:
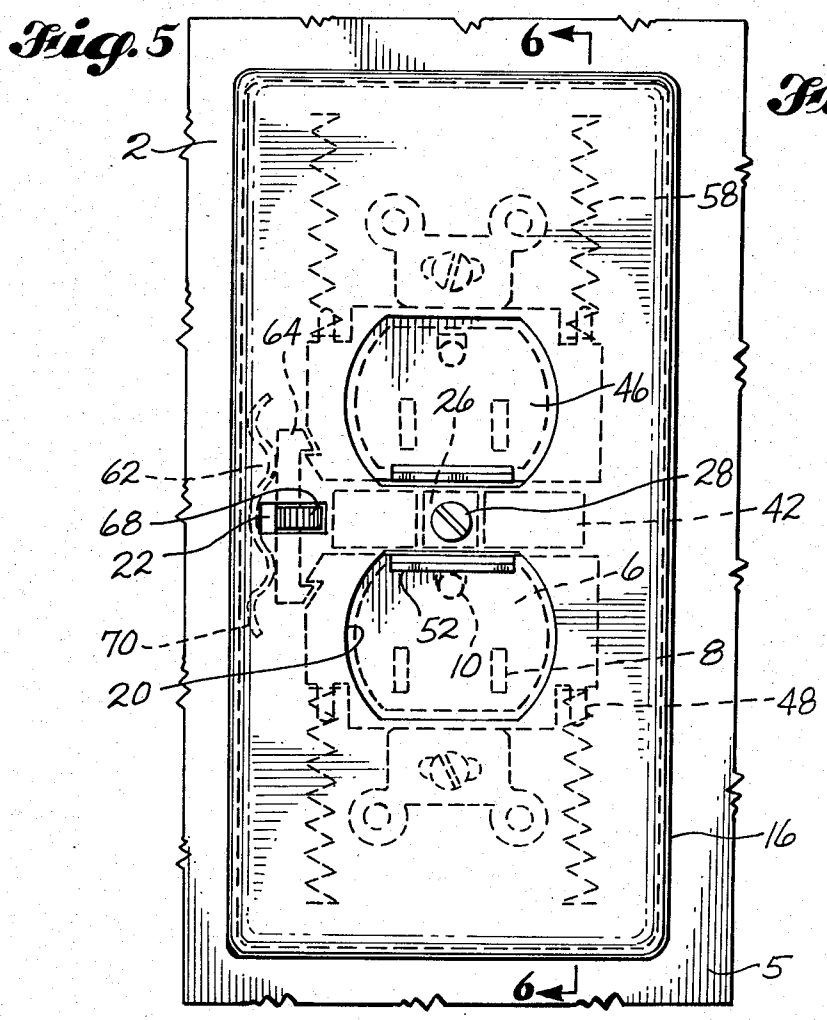
FIG. 5 is like FIG. 4 except that the electrical plugs are omitted and the shutters are shown in their closed positions.

The drawings show a faceplate 2 for an electrical outlet that is constructed according to the invention and that also constitutes the best mode for carrying out the invention currently known to the applicant. In FIGS. 2-6, the faceplate 2 is shown in use to cover an electrical outlet 4 of the type having two receptacles 6 for receiving electrical plugs 12. Each receptacle 6 is a standard modern receptacle with two rectangular openings 8 for the rectangular prongs of an electrical cord and a round opening 10 for the ground pin of the cord.

The faceplate 2 shown in the drawings comprises a body 16,30 that includes a front or outer plate 16 and an inner liner 30, which form outer and inner wall portions of the body 16,30, respectively. The front plate 16 is similar in shape to an ordinary electrical outlet faceplate and has a front surface that is parallel to the surface of the wall 5 in which the outlet 4 is mounted, and a peripheral sidewall 18 that extends perpendicularly from the front surface and engages the wall 5 around the outlet 4. The front plate 16 is dimensioned to cover the outlet 4 and has a pair of apertures 20 therein that are alignable with the receptacles 6 of the outlet 4 to allow insertion of the prongs of an electrical plug 12 into the openings 8,10 of the receptacles 6. The front plate 16 also has a center screw opening 24 for receiving a screw 28 to attach the faceplate 2 to an outlet 4 in a known manner. A release button hole or window 22 extends through the front plate 16 and is laterally spaced from and aligned with the screw hole 24. The edge of the sidewall 18 may be provided with an insulating material to sealingly engage the wall 5 and prevent drafts from entering the room in which the outlet 4 is located.

The liner 30 includes a rear wall 32 that is parallel to and spaced from the front wall of the front plate 16. The rear wall 32 has a pair of apertures 34 extending therethrough in alignment with the apertures 20 in the front plate 16. The liner 30 also includes edge portions 40 that extend perpendicularly outwardly from the rear wall 32 to the front wall of the front plate 16. At each of its four corners, the liner 30 forms a spring recess 36, which is dimensioned to receive and position a coil spring 58. A laterally extending center ridge 38 is formed at the vertical center of the liner 30 between the two apertures 34. This ridge 38 is dimensioned to be received between the receptacles 6 of the outlet 4 to prevent the faceplate 2 from pivoting relative to the outlet 4. Preferably, center spaces 42 are provided between the front wall of the front plate 16 and the wall portions of the liner 30 forming the center ridge 38 to maintain the correct spacing between the front plate 16 and the liner 30 and to provide the ridge 38 with additional strength. In the preferred embodiment shown in the drawings, the front plate 16 has a screw lug 26 formed on its back surface. The screw hole 24 extends through this lug 26, and the lug 26 forms the center portion of the laterally extending center mounting ridge.

As noted above, the center ridge 38 functions to correctly position the faceplate 2 with respect to the outlet 4 and to prevent unwanted movement of the faceplate 2. The apertures 34 in the liner 30 are preferably dimensioned and positioned to allow the receptacles 6 to extend part of the way into the apertures 34. This arrangement adds further security to the proper positioning of the faceplate 2 relative to the outlet 4. The receptacles 6 should extend only part of the way into the apertures 34 in order to ensure that they do not interfere with the functioning of the shutters 46, described below.

The faceplate 2 has a shutter 46 corresponding to each receptacle 6 of the outlet 4 and each aperture 20,34 through the body 16,30 of the faceplate 2. Each shutter 46 slides between the rear wall 32 of the liner 30 and the front wall of the front plate 16. The front wall of the front plate 16 and the rear wall 32 and edge portions 40 of the liner 30 form guide surfaces for guiding movement of the shutters 46. Each shutter 46 reciprocates between a closed position, shown in FIGS 3, 5, and 6 and the top of FIG. 2, and an open position, shown in FIG. 4 and the bottom of FIG. 2. In its closed position, the shutter 46 blocks the corresponding aperture 20,34 in the body 16,30 to prevent any object from being inserted into the openings 8,10 of the receptacle 6. In its open position, the shutter 46 is adjacent to the aperture 20,34 and allows free access to the receptacle 6 to permit the prongs of an electrical plug 12 to be inserted in the openings 8,10.

Each shutter 46 is preferably generally rectangular in shape and slides in a vertical direction between its open and closed positions. One corner of the shutter 46 that is adjacent to the center ridge 38 when the shutter 46 is in its closed position has a cam surface 51 and an adjacent triangular cutout 50 that forms an interlocking surface, which function as described below. The two corners of the shutter 46 opposite the center ridge 38 are partially cut away to form spring engaging pins 48 and spring abutments 49. Each pin 48 is received into the corresponding spring 58 and slides in the spring recess 36 to compress the spring 58 when the shutter 46 is moved from its closed to its open position. The spring 58 is compressed between the spring abutment 49 formed on the shutter 46 and the spring abutment 37 formed by the outer end of the spring recess 36.

Each shutter 46 is provided with tab means for manually sliding the shutter 46 from its closed position into its open position against the force of the coil springs 58. In the preferred embodiment shown in the drawings, the tab means comprises a projection 52 that projects substantially perpendicularly outwardly from the edge of the shutter 46 adjacent to the center ridge 38, bends at a right angle to extend generally parallel to the shutter 46, and then bends again to terminate in a finger tab 54. As can be seen in the drawings, the finger tab 54 is essentially perpendicular to the front surface of the front plate 16 and the wall 5 in which the outlet 4 is mounted. The projection 52 projects forwrdly from the shutter 46 and is positioned and dimensioned to allow a person to hold the shutter 46 in its open position by pressing a finger F against the finger tab 54 without blocking any portion of the aperture 20,34 with such finger F. This is illustrated in the bottom portion of FIG. 2. The portion of the projection 52 that extends perpendicularly from the main face of the shutter 46 includes opposite surfaces 56,57 that form stop surfaces 56,57. These stop surfaces 56,57 engage the edges of the front plate 16 that define the aperture 20 to limit movement of the shutter 46 in the direction of its closed position and open position, respectively.

The faceplate 2 is provided with a lock 62 for positively locking each shutter 46 into its closed position and preventing the shutters 46 from sliding out of their closed positions toward their open positions. The lock 62 includes an interlocking sliding member 64. This member 64 is received between the front wall of the front plate 16 and the rear wall 32 of the liner 30. The member 64 reciprocates between an engaged position in which it interlocks with the shutters 46 to hold them in their closed positions, and a disengaged position in which it is clear of the shutters 46 to allow the shutters 46 to be moved into their open positions by pressing on the finger tabs 54. The front plate 16 and liner 30 cooperate to guide the sliding member 64 in its reciprocating movement. The sliding member 64 has a rectangular main portion with a hook or triangular projection 66 extending laterally inwardly from each end. Each projection 66 has a cam surface 72 that interacts with the cam surface 51 on the corresponding shutter 46. The triangular projections 66 interlock with the triangular cutouts 50 on the shutters 46 to prevent movement of the shutters 46 out of their closed positions toward their open positions. A release button 68 is secured to the slide member 64 and extends forwardly therefrom through the window 22 in the front plate 16. A spring 70 biases the sliding member 64 toward the shutters 46 and the hooks 66 into engagement with the triangular cutouts 50.

In the preferred embodiment, all the parts of the faceplate 2, except the coil springs 58, are made from molded plastic. The spring 70 is preferably integrally formed with the liner 30, but is shown separate from the liner 30 in FIG. 1 for purposes of clarity.

Once a faceplate 2 has been installed on an electrical outlet 4 by means of a scrw 28, the operation of the faceplate 2 is as follows. When it is desired to insert an electrical plug 12 into one of the receptacles 6, the release button 68 is slid laterally outwardly to move the interlocking sliding member 64 of the lock 62 laterally outwardly out of engagement with the shutters 46. This frees the shutters 46 and allows either or both of them to be moved out of their closed positions into their open positions by pressing on the finger tabs 54. Normally, only one shutter 46 is moved toward its open position. After the shutter 46 has been moved a portion of the way toward its open position, the pressure on the release button 68 of the lock 62 may be removed while the pressure on the finger tab 54 is continued to move the shutter 46 the rest of the way into its open position. When the shutter 46 is fully opened, a plug may be inserted into the receptacle 6 of the outlet 4. Then the pressure on the finger tab 54 of the shutter 46 may be removed. The engagement of the shutter 46 against the plug 12 prevents the closing of the shutter 46. The removal of the pressure on the release button 68 allows the resilient spring 70 to move the interlocking slide member 64 back into engagement with the other shutter 46 to prevent such other shutter 46 from being opened until the release button 68 is again operated to release the lock means 62.

When the plug 12 is removed from the receptacle 6 by an adult or a child, or by accident, the springs 58 automatically close the shutter 46. The cam surface 51 on the shutter 46 engages the cam surface 72 on the sliding member 64 of the lock 62 to move the member 64 an amount just sufficient to allow the shutter 46 to completely close. Then, the spring 70 moves member 64 back into position to securely lock the shutter 46 in its closed position.

Although the preferred embodiment of the invention has been illustrated and described herein, it is intended to be understood by those skilled in the art that various modifications and omissions in form and detail may be made without departing from the spirit and scope of the invention as defined in the following claims.

What is claimed is:

1. A faceplate for an electrical outlet of the type having at least one set of openings for receiving prongs of an electrical plug, said faceplate comprising:

a body dimensioned to cover the outlet and having an aperture therein alignable with said openings to allow insertion of said prongs into said openings;

a shutter having a closed position in which it blocks said aperture and an open position in which it is adjacent to said aperture; said shutter including an edge portion with an interlocking surface;

spring means for biasing the shutter into its closed position;

tab means carried by the shutter for manually sliding the shutter from its closed position into its open position against the force of the spring means; and releasable lock means for preventing the shutter from sliding out of its closed position toward its open position; said lock means including an interlocking portion, resilient means for urging said interlocking portion toward the shutter and into interlocking engagement with said interlocking surface of the shutter to positively lock the shutter against sliding out of its closed position toward its open position, and a release member carried by said interlocking portion for manually sliding said interlocking portion against the force of the resilient means away from the shutter and out of engagement with said interlocking surface to allow the tab means to be operated to slide the shutter into its open position.

2. A faceplate as described in claim 1, in which the tab means comprises a projection that projects substantially perpendicularly outwardly from an edge of the shutter, extends generally parallel to the shutter, and terminates in a finger tab; said projection being positioned and dimensioned to allow a person to hold the shutter in its open position by pressing a finger against the finger tab without blocking any portion of the aperture with said finger.

3. A faceplate as described in claim 2, in which said projection includes a stop surface that abuts said body when the shutter is in its closed position.

4. A faceplate as described in claim 2, in which said projection includes two opposite stop surfaces that abut said body when the shutter is in its closed and open positions, respectively.

5. A faceplate as described in claim 1, in which said body includes outer wall means and inner wall means between which the shutter and said interlocking portion of the lock means slide and which form guide surfaces for guiding movement of the shutter and said interlocking portion.

6. A faceplate as described in claim 5, in which said spring means includes two coil springs that engage opposite corner portions of the shutter, and said inner and outer wall means define therebetween recesses for receiving and positioning said springs.

7. A faceplate as described in claim 5, in which said inner wall means is formed from molded plastic, and said resilient means is formed integrally with said inner wall means.

8. A faceplate for an electrical outlet of the type having two sets of openings for receiving prongs of two electrical plugs, said faceplate comprising:

a body dimensioned to cover the outlet and having a pair of apertures therein, each said aperture being alignable with a different one of said sets of openings to allow insertion of said prongs into said openings;

a shutter corresponding to each aperture, each said shutter having a closed position in which it blocks the corresponding aperture and an open position in which it is adjacent to the corresponding aperture, and each said shutter including an edge portion with an interlocking surface;

spring means for biasing the shutters into their closed positions;

tab means carried by each shutter for manually sliding the shutter from its closed position into its open position against the force of the spring means; and releasable lock means for preventing the shutters from sliding out of their closed positions toward their open positions; said lock means including an interlocking portion, resilient means for urging said interlocking portion toward the shutters and into interlocking engagement with said interlocking surfaces of the shutters to positively lock the shutters against sliding out of their closed positions toward their open positions, and a release member carried by said interlocking portion for manually sliding said interlocking portion against the force of the resilient means away from the shutters and out of engagement with said interlocking surfaces to allow the tab means to be operated to slide the shutters into their open positions.

9. A faceplate as described in claim 8, in which each tab means comprises a projection that projects substantially perpendicularly outwardly from an edge of the shutter, extends generally parallel to the shutter, and terminates in a finger tab; said projection being positioned and dimensioned to allow a person to hold the shutter in its open position by pressing a finger against the finger tab without blocking any portion of the corresponding aperture with said finger.

10. A faceplate as described in claim 8, in which said body includes outer wall means and inner wall means between which the shutters and said interlocking portion of the lock means slide and which form guide surfaces for guiding movement of the shutters and said interlocking portion.

11. A faceplate as described in claim 10, in which said inner wall means is formed from molded plastic, and said resilient means is formed integrally with said inner wall means.

* * * * *